US010520167B2

(12) United States Patent
Duckworth

(10) Patent No.: US 10,520,167 B2
(45) Date of Patent: Dec. 31, 2019

(54) LUMINAIRE

(71) Applicant: Hubbell Incorporated, Shelton, CT (US)

(72) Inventor: Jason E. Duckworth, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 338 days.

(21) Appl. No.: 14/973,107

(22) Filed: Dec. 17, 2015

(65) Prior Publication Data

US 2016/0161101 A1 Jun. 9, 2016

Related U.S. Application Data

(63) Continuation-in-part of application No. 29/510,811, filed on Dec. 3, 2014.

(60) Provisional application No. 62/096,132, filed on Dec. 23, 2014.

(51) Int. Cl.

| | |
|---|---|
| ***F21V 15/01*** | (2006.01) |
| ***F21V 29/76*** | (2015.01) |
| *F21V 23/04* | (2006.01) |
| *F21Y 105/10* | (2016.01) |
| *F21Y 115/10* | (2016.01) |

(52) U.S. Cl.

CPC ..... *F21V 15/01* (2013.01); *F21V 29/763* (2015.01); *F21V 23/0442* (2013.01); *F21Y 2105/10* (2016.08); *F21Y 2115/10* (2016.08)

(58) Field of Classification Search

USPC ..... 362/235

See application file for complete search history.

(56) References Cited

U.S. PATENT DOCUMENTS

| | | | | |
|---|---|---|---|---|
| D444,903 | S | 7/2001 | Wang | |
| 6,330,153 | B1 * | 12/2001 | Ketonen | H05K 7/20145 165/104.33 |
| D556,143 | S | 11/2007 | Ni | |
| D559,795 | S | 1/2008 | Valentin et al. | |
| D566,318 | S | 4/2008 | Quiogue et al. | |
| D568,259 | S | 5/2008 | Valentin et al. | |

(Continued)

OTHER PUBLICATIONS

Cooper Lighting, "Quadcast LED—Parking Garage and Canopy Luminaire", Lumark Quadcast Brochure, available since Nov. 7, 2014, 8 pages, Cooper Industries plc, Houston, TX, USA, www.cooperindustries.com.

*Primary Examiner* — Rafferty D Kelly

(74) *Attorney, Agent, or Firm* — Michael Best & Friedrich, LLP

(57) ABSTRACT

A luminaire includes a housing, a heat sink, and a light assembly. The housing includes a pair of elongated, parallel legs and a cross-member extending between the legs. The cross-member defines a first surface and a second surface opposite the first surface, and the first surface includes an opening. The heat sink is coupled to the housing proximate the second surface of the cross-member. The heat sink is positioned between the legs and the heat sink includes a plate and a fin array. The plate defines a first surface and a second surface opposite the first surface, and the fin array including a plurality of fins protruding from the first surface. The light assembly is coupled to the second surface of the heat sink and includes at least one light-emitting element (e.g., a light-emitting diode or LED).

29 Claims, 11 Drawing Sheets

(56) References Cited

U.S. PATENT DOCUMENTS

| | | | | |
|---|---|---|---|---|
| D574,102 | S | 7/2008 | Quiogue et al. | |
| D660,491 | S | 5/2012 | Holscher | |
| D692,836 | S | 11/2013 | Thomas et al. | |
| D735,378 | S | 7/2015 | Mozdzer | |
| D770,074 | S | 10/2016 | Romano et al. | |
| 2004/0257808 | A1* | 12/2004 | Bjornson ..... | A61N 5/062<br>362/249.01 |

* cited by examiner

LUMINAIRE

REFERENCE TO RELATED APPLICATIONS

This application claims the benefit of prior-filed, U.S. Provisional Patent Application Ser. No. 62/096,132, filed Dec. 23, 2014, the entire contents of which are hereby incorporated by reference. This application is a continuation-in-part of U.S. Design patent application Ser. No. 29/510,811, filed Dec. 3, 2014, the entire contents of which are hereby incorporated by reference.

BACKGROUND

The present application relates generally to lighting fixtures and particularly to a luminaire.

Conventional luminaires include a housing supporting a light assembly including one or more light-emitting diodes or LEDs. The light assembly is in electrical communication with an electrical power source. Each LED generates heat, which is transferred to a heat sink in order to maintain an optimum operating temperature and efficiency of the LEDs. In some applications, it can be difficult to generate sufficient air flow to cool the heat sink, which impacts the performance of the luminaire.

SUMMARY

In one aspect, a luminaire includes a housing, a heat sink, and a light assembly. The housing includes a pair of elongated, parallel legs and a cross-member extending between the legs. The cross-member defines a first surface and a second surface spaced apart from the first surface, and the first surface includes an opening. The heat sink is coupled to the housing and positioned proximate the second surface of the cross-member. The heat sink is positioned between the legs and the heat sink includes a plate and a fin array. The plate defines a first surface and a second surface opposite the first surface, and the fin array including a plurality of fins protruding from the first surface. The light assembly is coupled to the second surface of the heat sink and includes at least one light-emitting element.

In another aspect, a luminaire includes a housing, a heat sink, a circuit board, and a lens. The housing includes a first surface and a second surface opposite the first surface. The first surface includes an opening configured to receive an electrical conduit coupled to an electrical source. The heat sink is supported on the housing proximate the second surface and the heat sink includes a first side defining a mounting surface and a second side defining a fin array. The circuit board includes at least one light-emitting element and is coupled to the mounting surface. The lens extends over the circuit board and is coupled to the mounting surface independently of the circuit board.

In yet another aspect, a luminaire includes a housing, a heat sink, and a light assembly. The housing includes a first portion and a second portion. The first portion has a first surface and a second surface spaced apart from the first surface. The first portion defines a first axis extending from the first surface to the second surface. The first surface includes an opening configured to receive an electrical conduit in electrical communication with a power source. The first surface defines an uppermost portion of the housing. The heat sink is supported by the housing and positioned proximate the second surface, and the heat sink includes a plate and a fin array protruding from a surface of the plate. The plate has a first end, a second end, a first edge extending between the first end and the second end, and a second edge extending between the first end and the second end. The fin array defines at least one air flow channel having an inlet positioned proximate the first side of the plate. The light assembly includes at least one light-emitting element and a lens, and the light assembly is coupled to a surface of the plate opposite the fin array.

In still another aspect, a luminaire includes a housing, a heat sink, a seal, and a light assembly. The housing includes a main body and a support bracket. The main body includes an opening configured to receive an electrical conduit coupled to an electrical source. The heat sink is removably coupled to the support bracket, and the heat sink including a plate and a fin array. The plate includes a first surface and a second surface, and the fin array protrudes from the first surface. The seal is positioned between the heat sink and the main body to thermally insulate the main body relative to the heat sink. The light assembly is coupled to the second surface of the plate, and includes at least one light-emitting element and a lens.

In yet another aspect, a luminaire includes a housing, a heat sink, and a light assembly. The housing includes a main body having an internal compartment. The main body includes a first surface and a second surface spaced apart from and opposite the first surface. A first axis extends between the first surface and the second surface. The main body further includes a first end and a second end, and a second axis extends between the first end and the second end and is oriented perpendicular to the first axis. At least one of the first end and the second end includes an opening to permit access to the internal compartment. The heat sink is coupled to the main body proximate the second surface and is positioned along the first axis. The heat sink includes a plate and a fin array. The plate includes a first surface and a second surface, and the fin array protrudes from the first surface. The light assembly is coupled to the second surface of the plate and includes at least one light-emitting element and a lens.

Other aspects will become apparent by consideration of the detailed description and accompanying drawings.

DETAILED DESCRIPTION

Before any embodiments are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
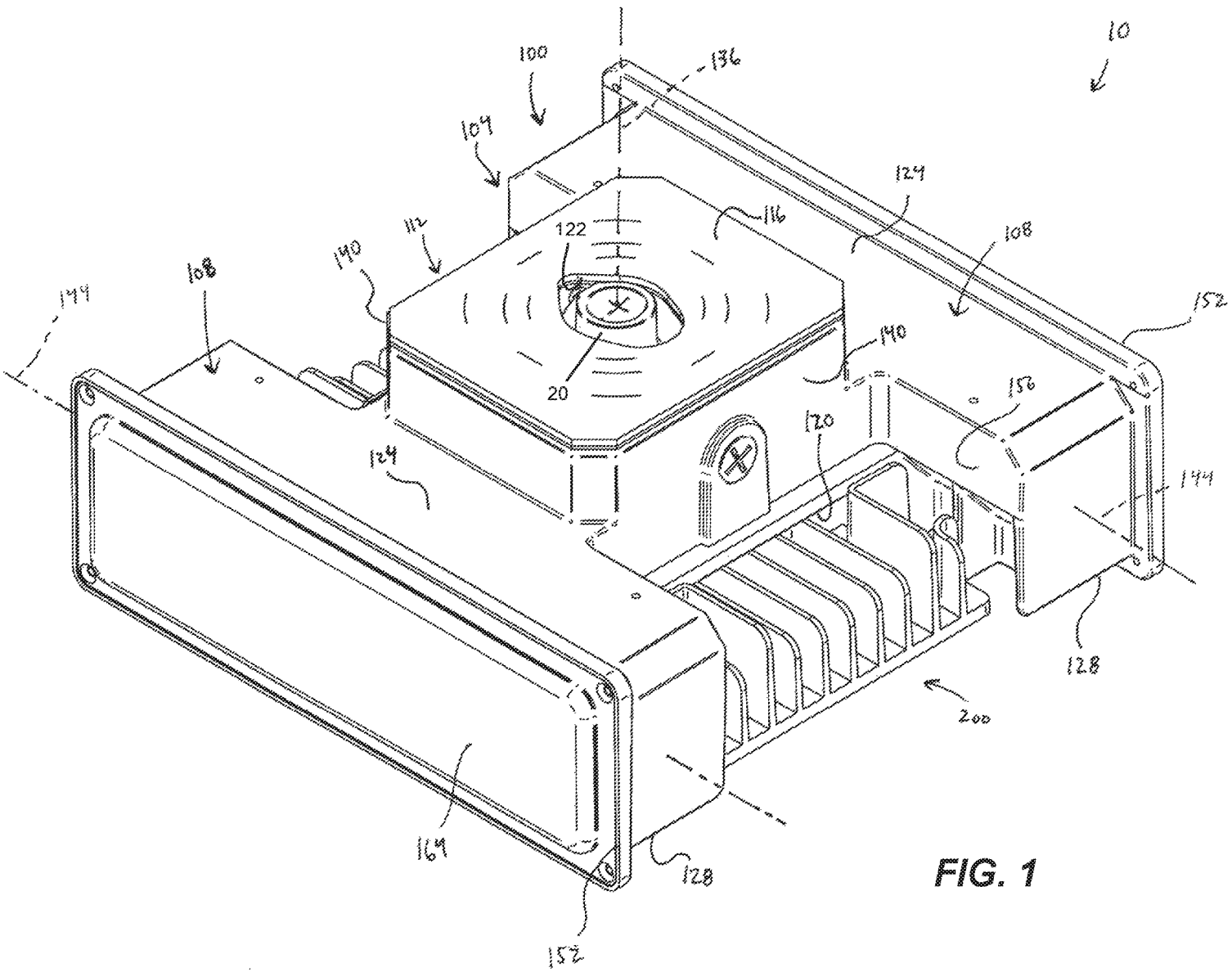
FIG. 1 is a perspective view of a luminaire.
Figure 2:
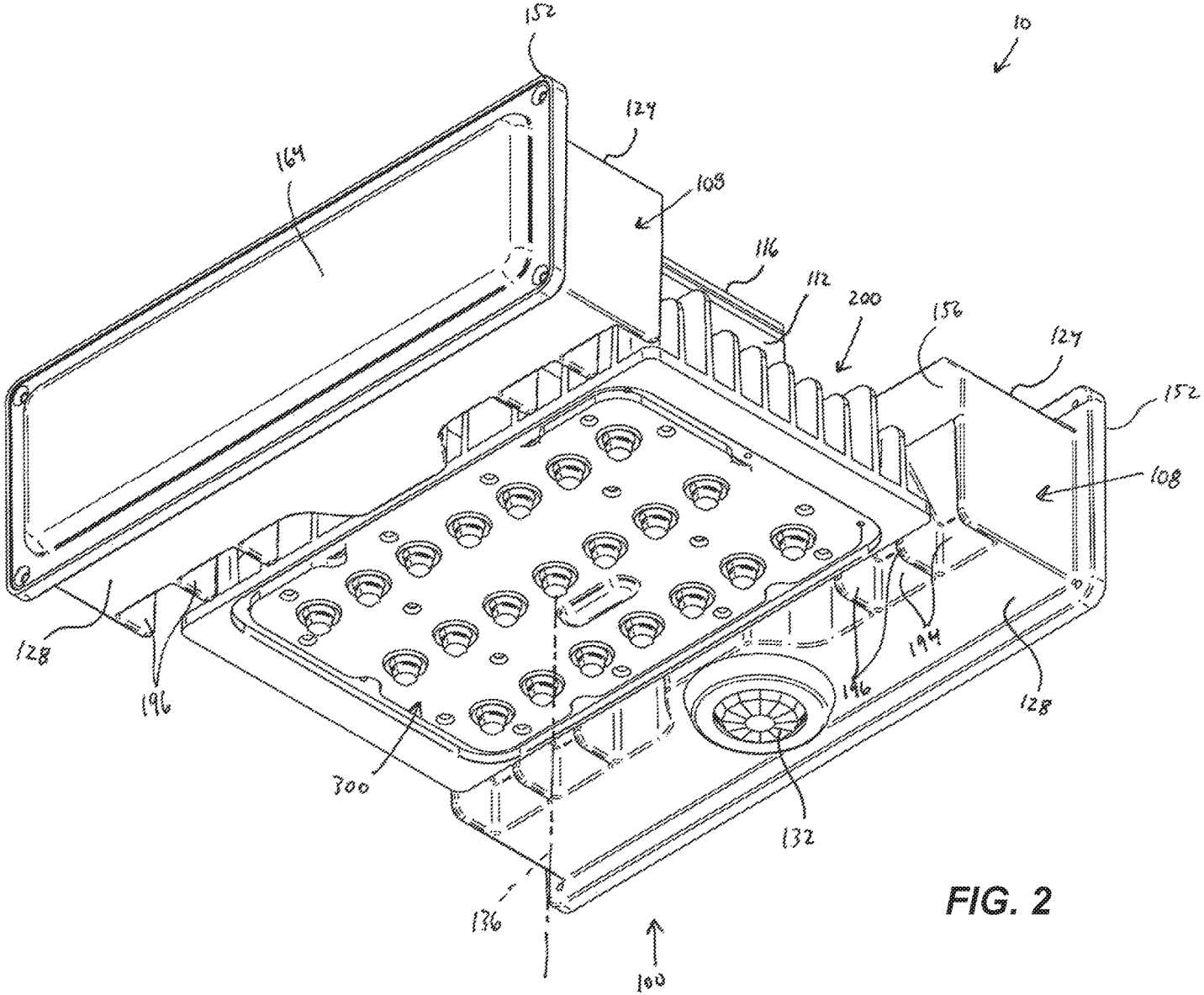
FIG. 2 is a lower perspective view of the luminaire of FIG. 1.
Figure 5:
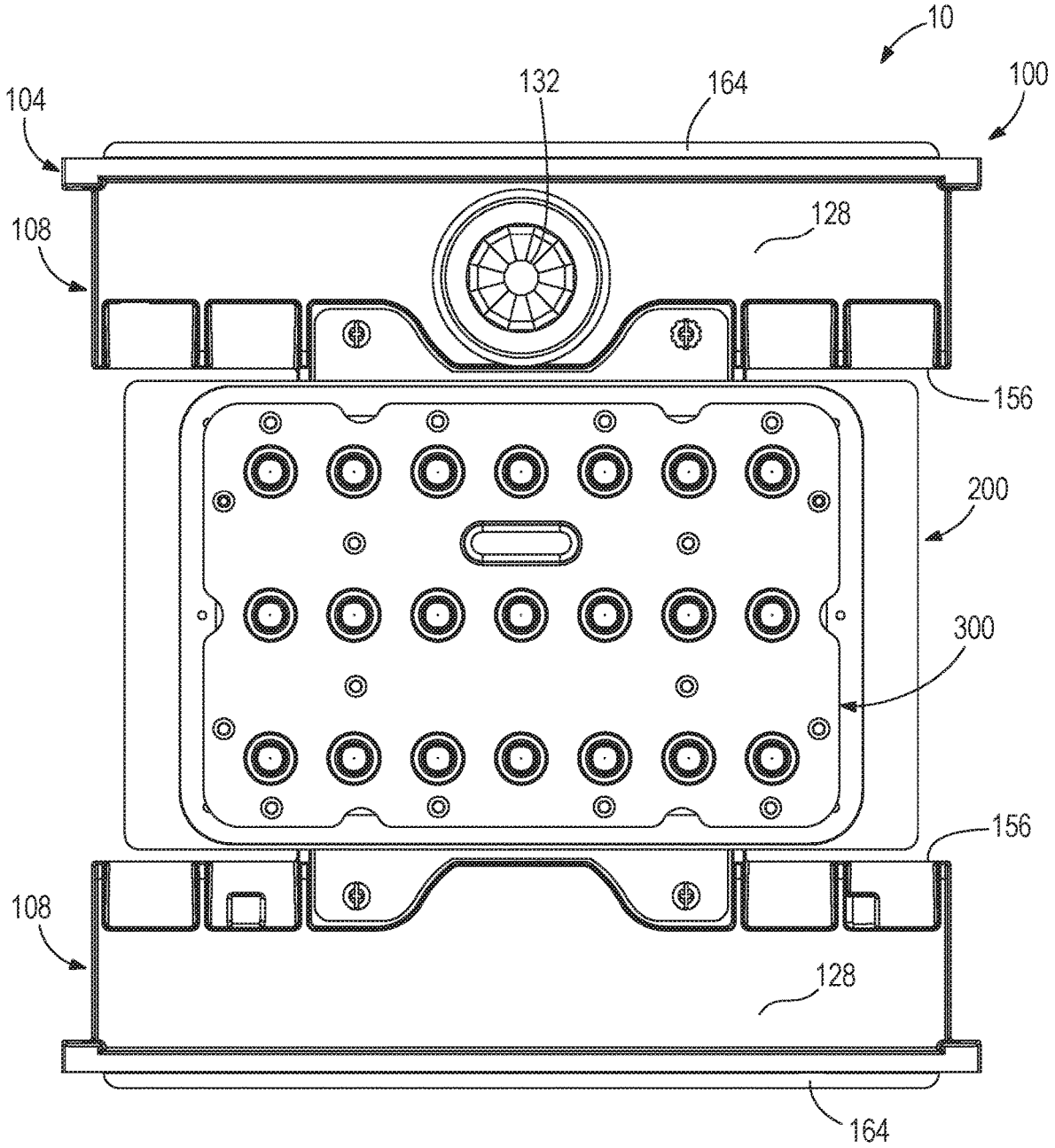
FIG. 5 is a bottom view of the luminaire of FIG. 1.

FIGS. 1-5 illustrate a luminaire 10 for an industrial application, such as illuminating a parking garage. The luminaire 10 includes a housing 100, a heat sink 200, and a light assembly 300 (FIGS. 2 and 5). In the illustrated embodiment, the housing 100 includes a main body 104 generally forming an H-shape having a pair of legs 108 and a cross-member 112. The cross-member 112 forms a first portion of the main body 104. The cross-member 112 includes a first or upper surface 116 and a second or lower surface 120 (FIGS. 1 and 3) opposite the upper surface 116. The upper surface 116 includes an opening 122 (FIGS. 1 and 4), and an electrical connector 20 passes through the opening 122. The connector 20 is coupled to an electrical source (e.g., a junction box, a pendant, a rigid electrical conduit, etc.—not shown) and provides electrical communication between the source and the luminaire 10.

Figure 3:
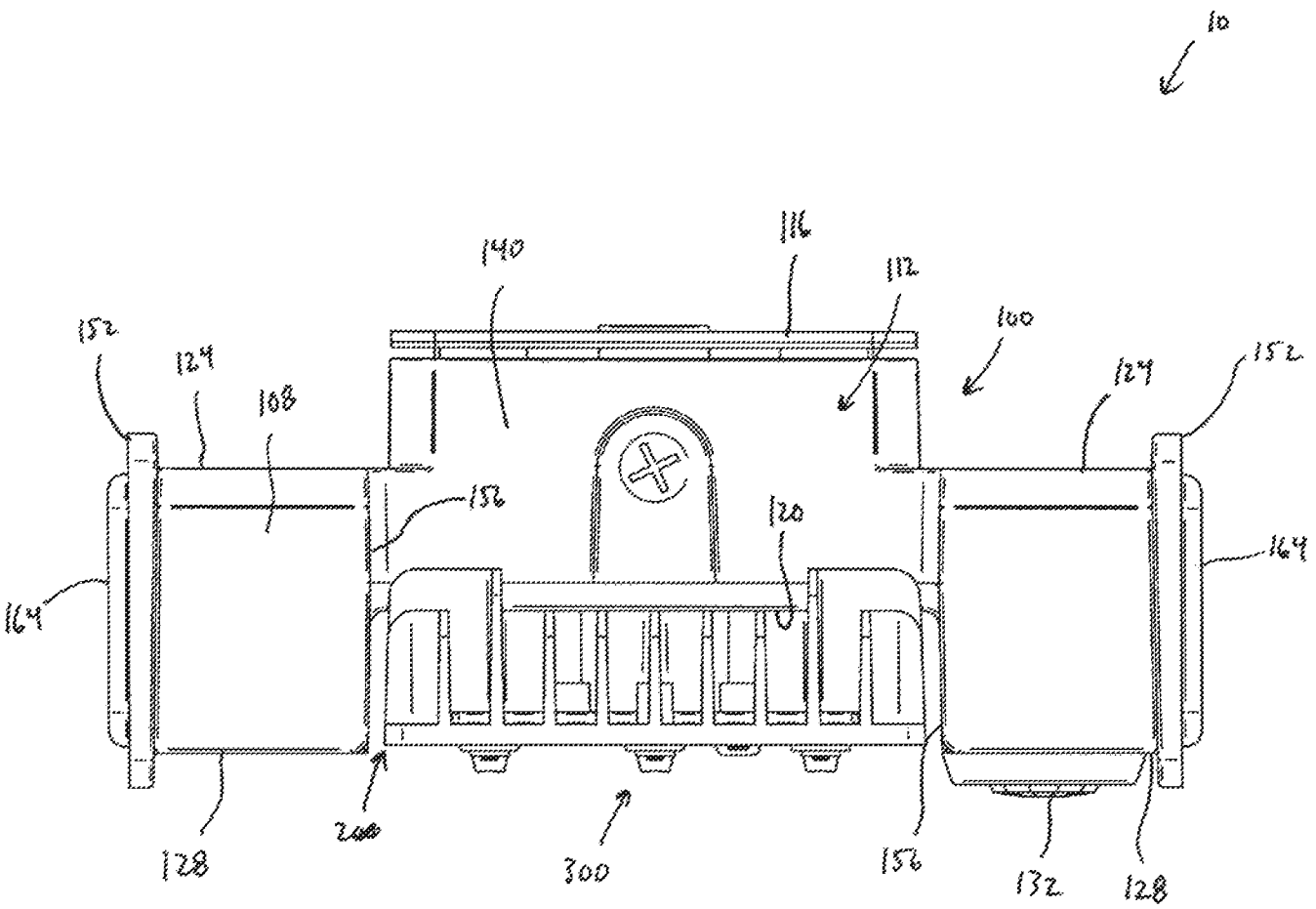
FIG. 3 is a side view of the luminaire of FIG. 1.
Figure 4:
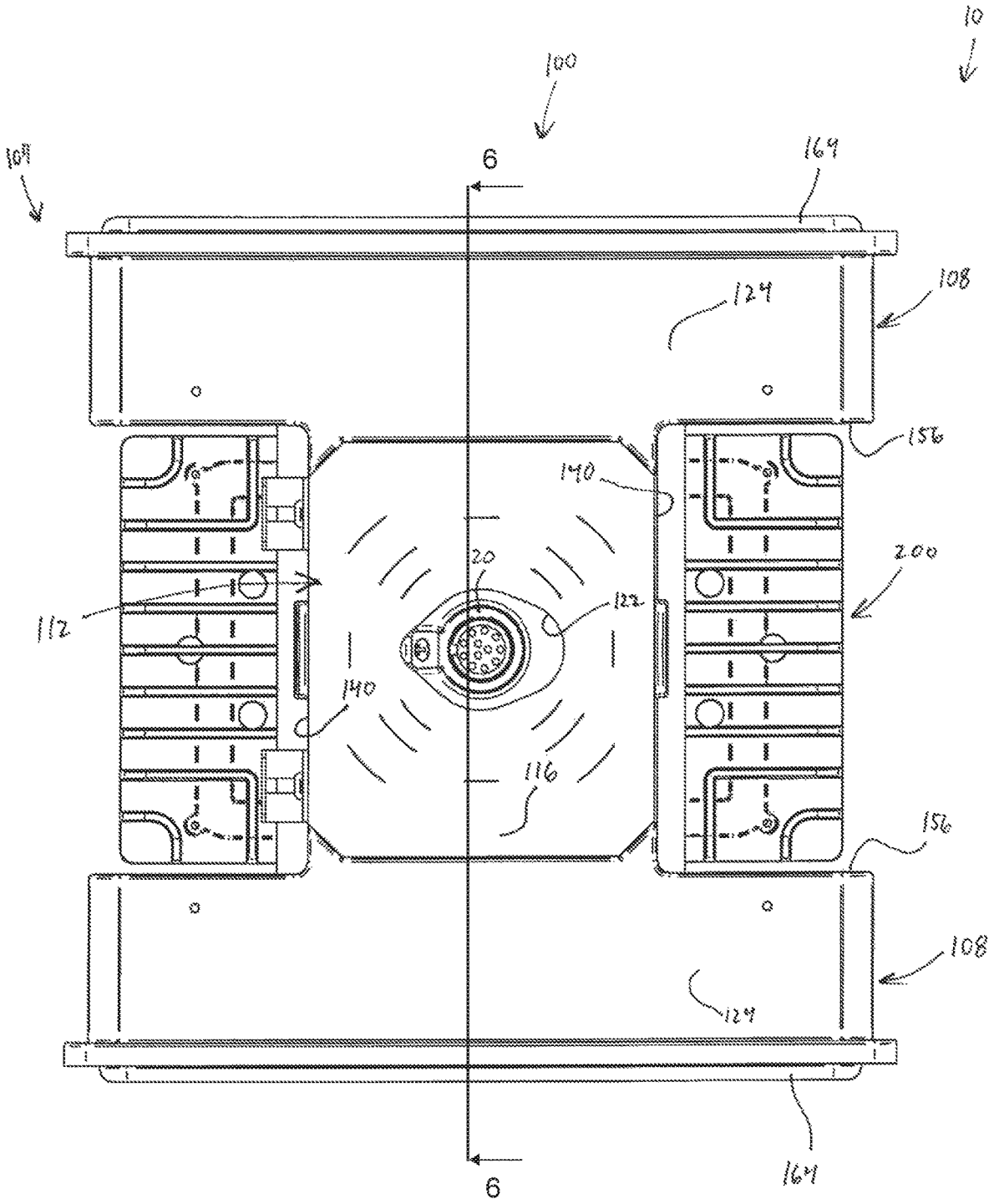
FIG. 4 is a top view of the luminaire of FIG. 1.

Referring to FIGS. 1-3, the legs 108 form second portions, and each leg 108 defines an upper extent 124 and a lower extent 128. A light sensor 132 (FIGS. 2 and 3) is positioned on the lower extent 128 of one leg 108. A first axis 136 extends through the upper surface 116 and the lower surface 120 of the cross-member 112, and the cross-member 112 extends in a direction that is perpendicular to the first axis 136. Unless otherwise specified, as used herein the term "axial" and its variants refer to a direction that is parallel to the first axis 136.

The lower surface 120 of the cross-member 112 is spaced apart from the upper surface 116 of the cross-member 112. The lower surface 120 of the cross-member 112 is axially offset from the upper extents 124 and the lower extents 128 of the legs 108. The upper surface 116 of the cross-member 112 defines a first plane, the lower extents 128 of the legs 108 define a second plane, and the lower surface 120 of the cross-member 112 is positioned between the first plane and the second plane. In the illustrated embodiment, the upper surface 116 of the cross-member 112 is also positioned above the upper extents 124 of the legs 108. In addition, the cross-member 112 includes side walls 140 extending between the upper surface 116 and the lower surface 120.

The legs 108 of the housing 100 are positioned on opposite sides of the cross-member 112, and each leg 108 extends along a leg axis 144 (FIGS. 1 and 2) perpendicular to the cross-member 112 axis. Each leg 108 extends beyond the side walls 140 of the cross-member 112, such that each end of the leg 108 is laterally spaced apart from a corresponding side wall 140.

Figure 6:
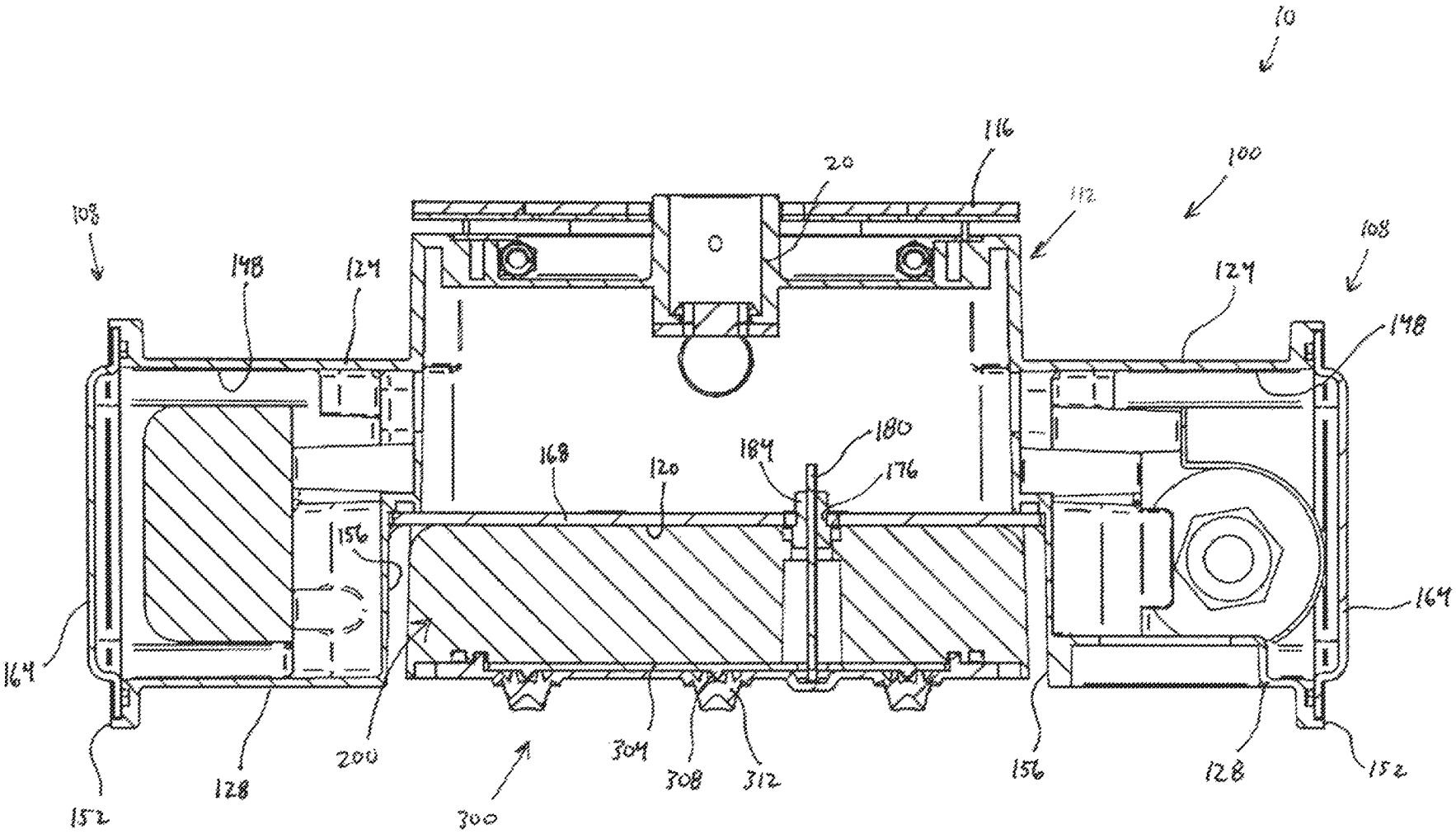
FIG. 6 is a section view of the luminaire of FIG. 4 viewed along section 6-6.

As shown in FIG. 6, each leg 108 defines an internal compartment or chamber 148. In one embodiment, the internal chamber 148 of one leg 108 includes one or more controllers or drivers, and the internal chamber 148 of the other leg 108 includes various sensors and accessories. Each leg 108 also includes an outer surface or outer side wall 152 and an inner surface or inner side wall 156. The outer side wall 152 may define an opening to permit access to the internal chamber 148, and the housing 100 further includes a removable cover 164 to selectively close the opening. The removable covers 164 provide manual access to the drivers and sensors even while the luminaire 10 is secured to an electrical source; that is, the internal chambers 148 are accessible from a side of the luminaire 10 without requiring the luminaire 10 to be dismounted.

Figure 7:
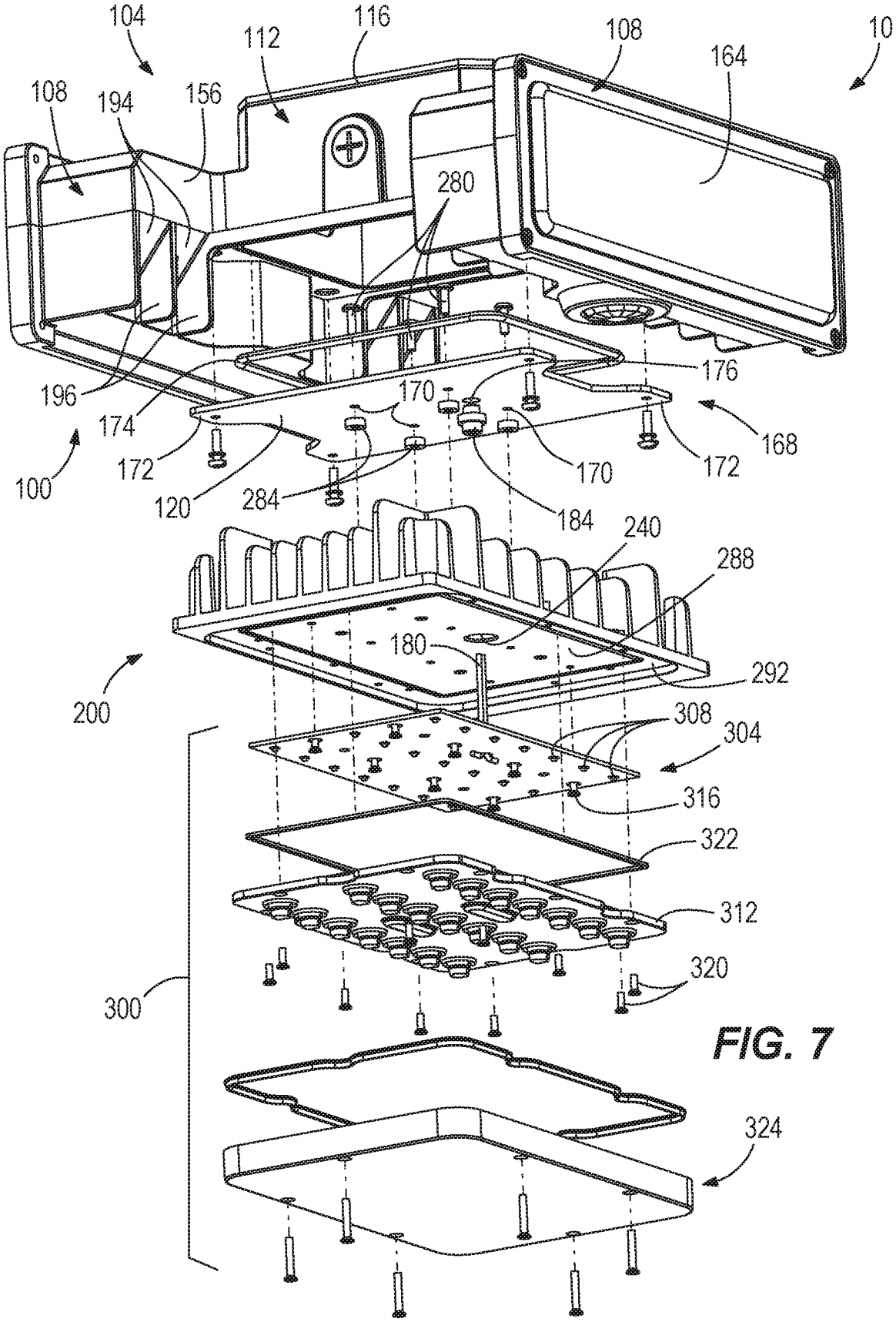
FIG. 7 is an exploded perspective view of the luminaire of FIG. 1.

Referring to FIG. 7, in the illustrated embodiment, the housing 100 further includes an elongated support bracket 168 removably coupled to the main body 104 and defining the lower surface 120 of the cross-member 112. The support bracket 168 extends between the legs 108 and is removably coupled (e.g., by threaded fasteners) to the cross-member 112. In the illustrated embodiment, the support bracket 168 includes holes 170 for receiving a second set of fasteners 280 (see below). A seal 174 is positioned between the support bracket 168 and the main body 104 to thermally insulate the main body 104 from the support bracket 168. The support bracket 168 also includes an opening 176 for receiving an electrical supply conduit 180. A grommet or seal 184 is positioned in the opening 176 to thermally insulate the conduit 180 from the support bracket 168 and heat sink 200. The heat sink 200 is coupled to the lower surface 120 of the cross-member 112 and the heat sink 200 is positioned between the legs 108.

Figure 8:
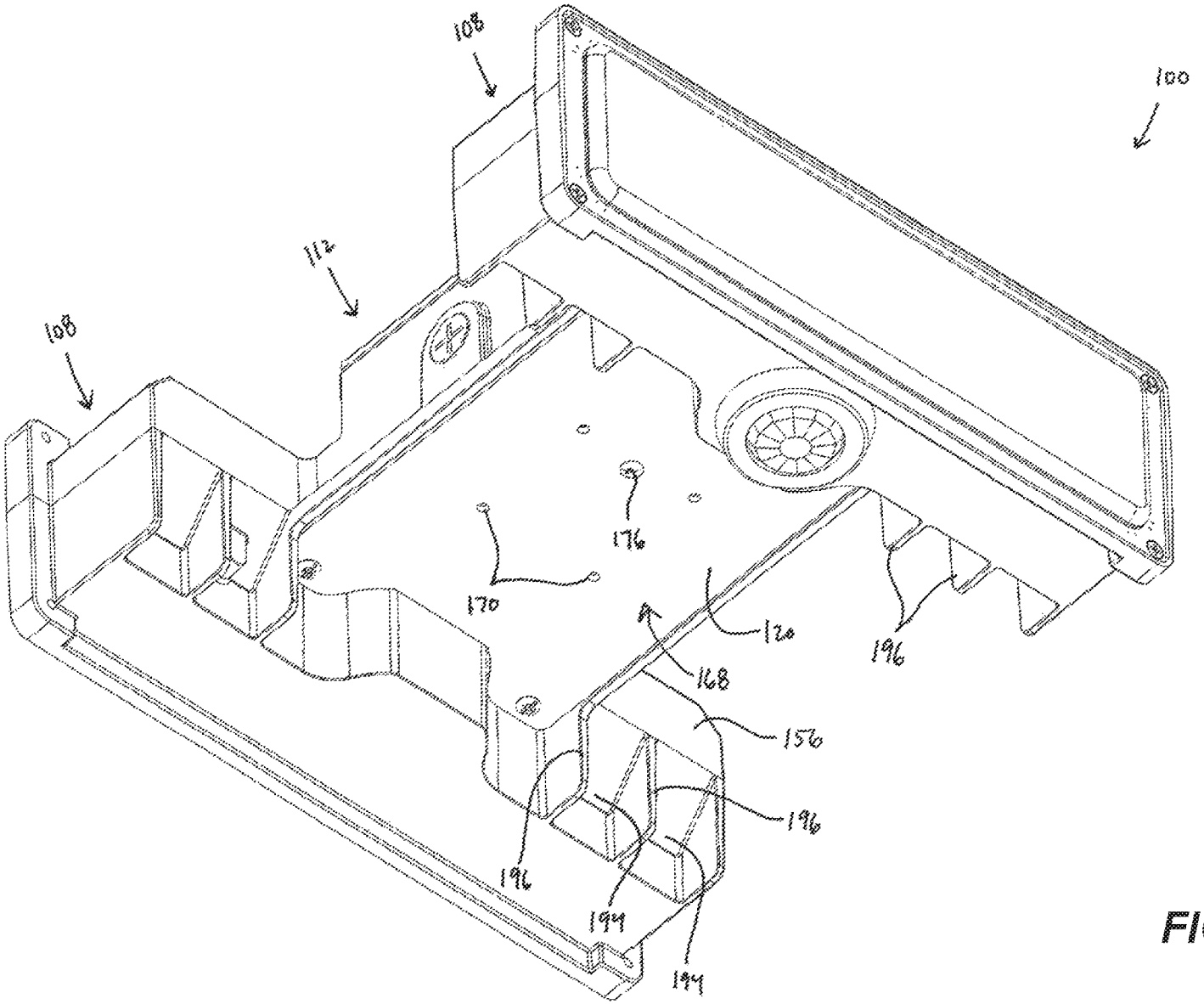
FIG. 8 is a lower perspective view of a housing.

As shown in FIG. 8, the inner side walls 156 of the legs 108 face toward one another. Each inner side wall 156 includes slots or grooves 194 adjacent the lower extent 128 of the leg 108. Each groove 194 is defined between a pair of tabs 196 and has a surface extending from the inner side wall 156 to the lower extent 128 of the leg 108.

Figure 9:
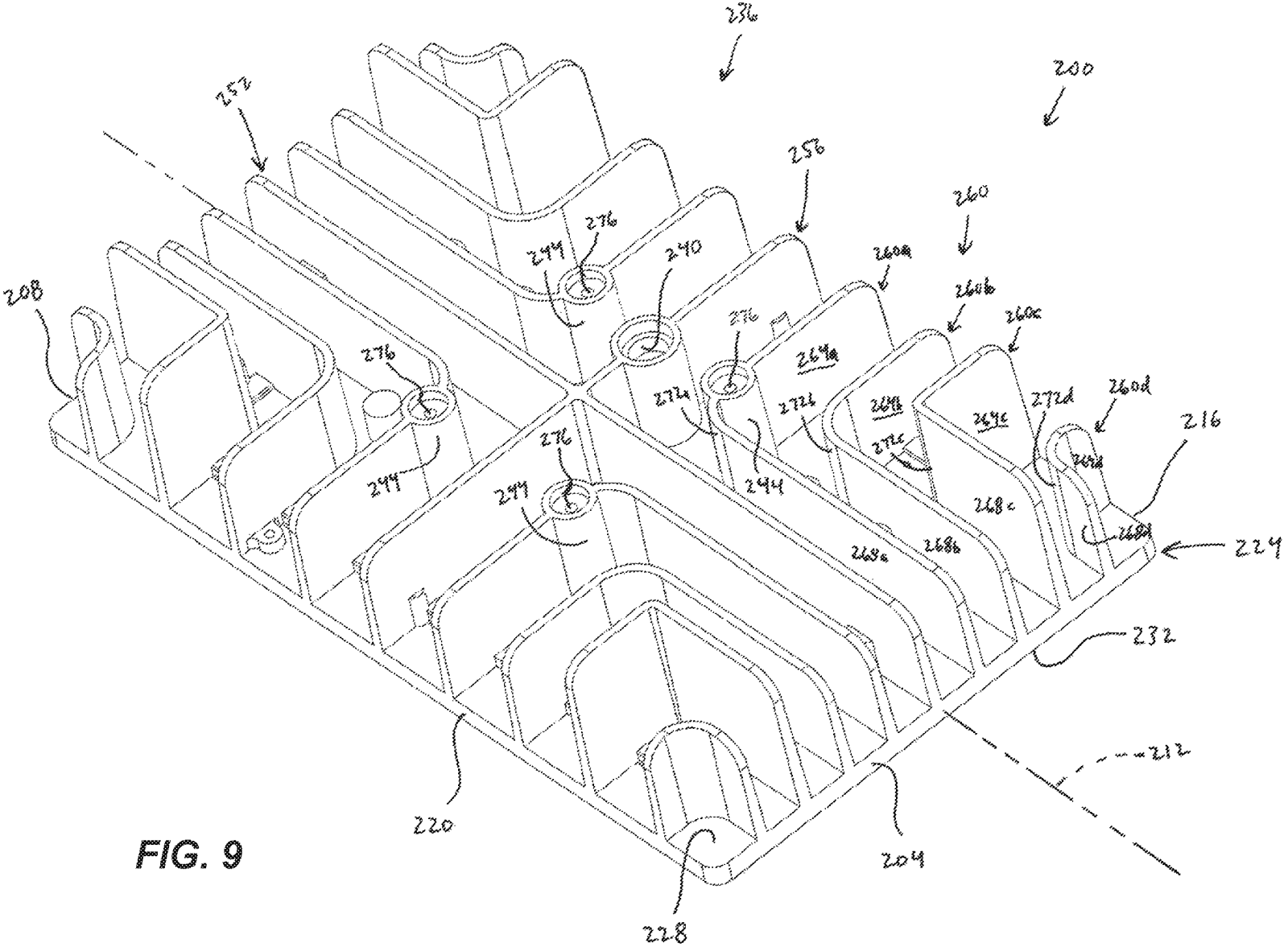
FIG. 9 is a perspective view of a heat sink.
Figure 10:
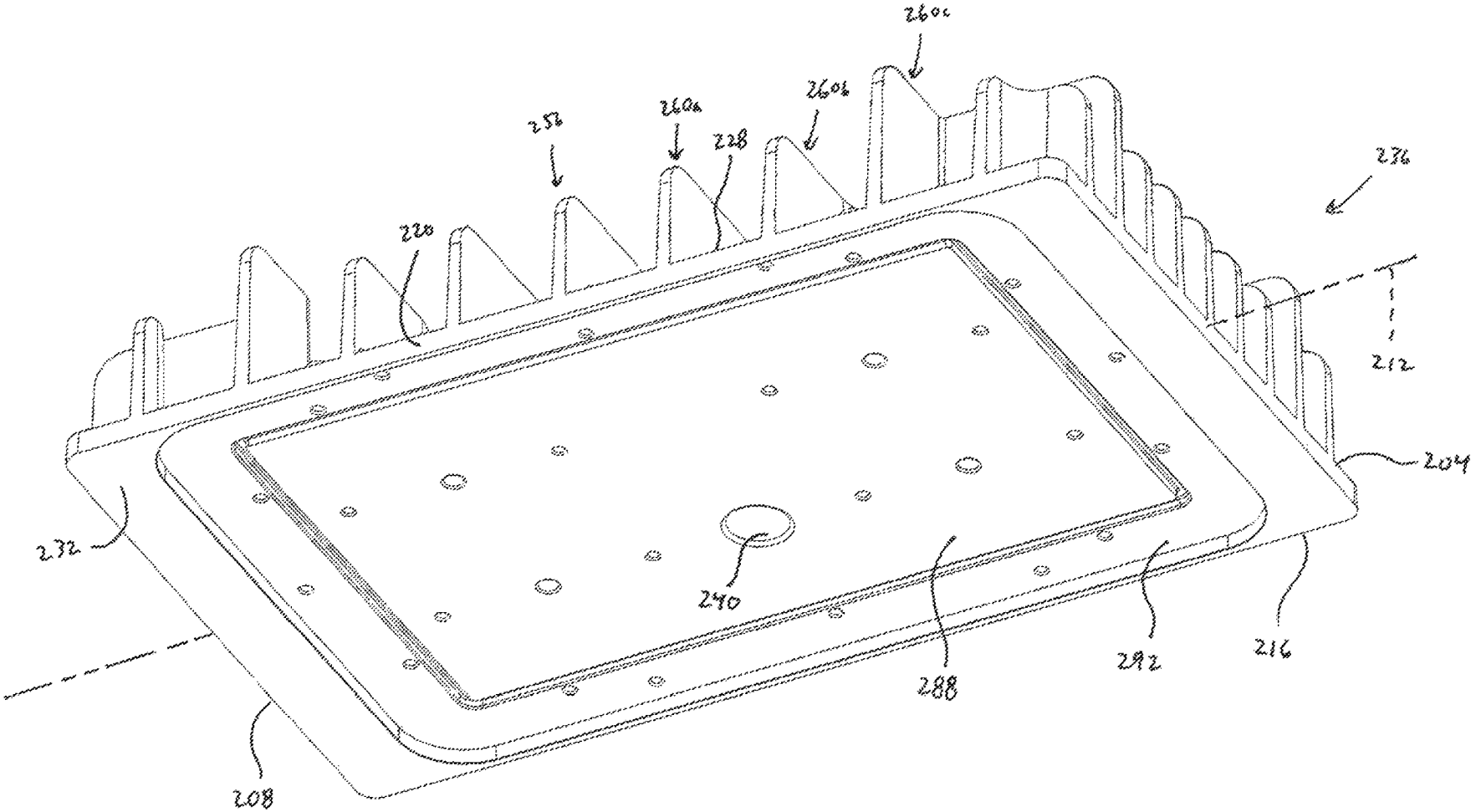
FIG. 10 is a lower perspective view of the heat sink of FIG. 9.

Referring now to FIGS. 9 and 10, the heat sink 200 has a first end 204 and a second end 208 and defines a heat sink axis 212 therebetween. The first end 204 and the second end 208 are laterally spaced apart from a corresponding side wall 140 of the cross-member 112. In other words, each end 204, 208 of the heat sink 200 extends beyond a plane defined by a corresponding side wall 140. The heat sink 200 includes a first side or first edge 216 extending between the first end 204 and the second end 208, and a second side or second edge 220 extending between the first end 204 and the second end 208. In the illustrated embodiment, the heat sink axis 212 extends parallel to and between the legs 108 (FIG. 8).

The heat sink 200 includes a plate 224 having a first surface 228 and a second surface or mounting surface 232. A fin array 236 is positioned on the first surface 228, while the mounting surface 232 supports the light assembly 300 (FIG. 7). The heat sink 200 further includes an opening or passageway 240 extending through the fin array 236 and the plate 224 to the mounting surface 232. The electrical conduit 180 (FIG. 7) passes through the passageway 240 to provide electrical communication between the drivers, controllers, etc. in the internal chambers 148 and the light assembly 300. In addition, the heat sink 200 includes multiple posts 244 aligned with holes 170 in the support bracket 168 (FIG. 3) to couple the heat sink 200 to the housing 100 (e.g., by a threaded fastener 280).

Figure 11:
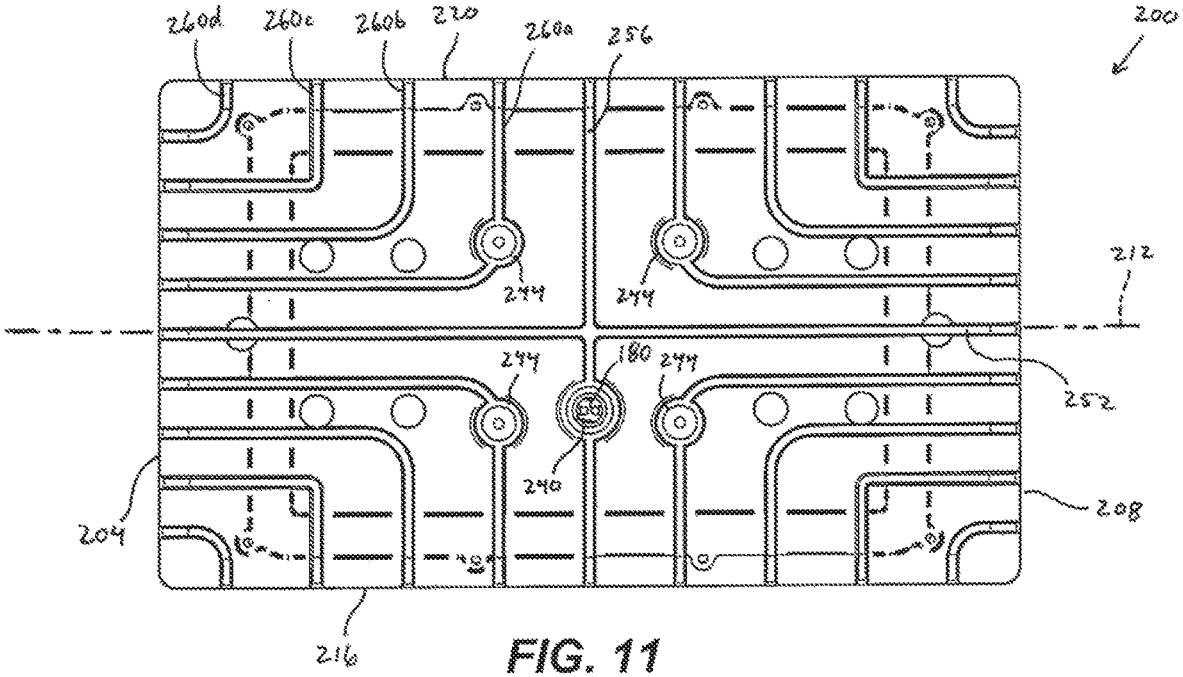
FIG. 11 is a top view of the heat sink of FIG. 9.

As best shown in FIG. 11, the fin array 236 includes a longitudinal fin 252 extending between the first end 204 and the second end 208 of the heat sink 200 (i.e., parallel to the heat sink axis 212), and a transverse fin 256 extending laterally across the heat sink 200. The transverse fin 256 and the longitudinal fin 252 intersect one another at a center point and define four quadrants of the heat sink 200. In the illustrated embodiment, the passageway 240 extends through a portion of the transverse fin 256.

Referring again to FIG. 9, the fin array 236 further includes elbow fins 260 positioned in each quadrant. Each elbow fin 260 includes a first planar portion 264 parallel to the longitudinal fin 252, a second planar portion 268 parallel to the transverse pin, and a connecting portion 272 extending between the first planar portion 264 and the second planar portion 268. Stated another way, the first portion 264 and the second portion 268 of each elbow fin 260 are oriented 90 degrees apart from one another and are connected by an arcuate portion. Air flow channels are defined between adjacent fins 252, 256, 260.

In one embodiment, the fin array 236 includes four elbow fins 260 positioned in each quadrant. The first elbow fin 260*a* is positioned nearest to the longitudinal fin 252 and transverse fin 256; the second elbow fin 260*b* is spaced apart from the first elbow fin 260*a* and positioned farther away from the longitudinal fin 252 and the transverse fin 256. The third elbow fin 260*c* is spaced apart from the second elbow fin 260*b* and positioned farther away from the longitudinal fin 252 and the transverse fin 256. The fourth elbow fin 260*d* is spaced apart from the third elbow fin 260*c* and is the elbow fin 260 that is the furthest distance from both the longitudinal fin 252 and the transverse fin 256. In other embodiments, the fin array 236 may include fewer or more elbow fins 260, and the spacing between the elbow fins 260 and the longitudinal fin 252 and/or the transverse fin 256 may be increased or decreased. In the illustrated embodiment, the third elbow fin 260*c* in each quadrant extends upwardly beyond the other fins 252, 256, 260; in other embodiments, the elbow fins 260 may have the same height, or a different elbow fin 260 may extend above the other fins 252, 256, 260. One or more of the elbow fins 260 may also have a height that is less than the other fins 252, 256, 260.

Figure 12:
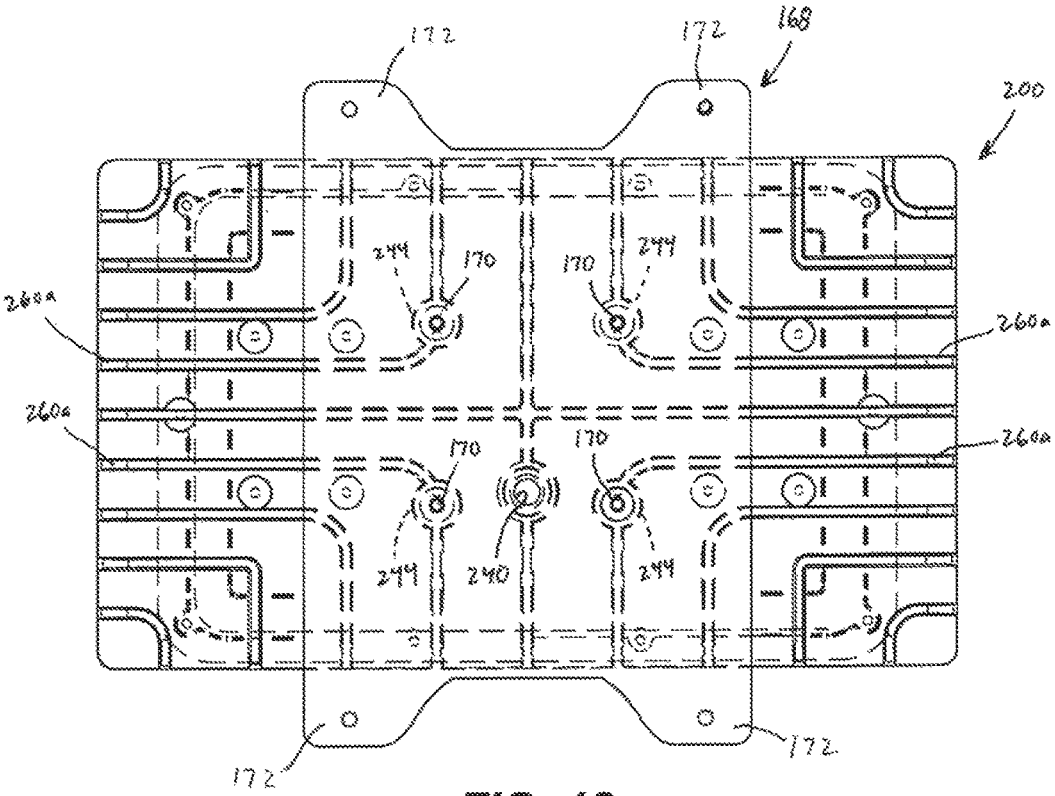
FIG. 12 is a top view of the heat sink of FIG. 9 and a support bracket.

Referring to FIG. 12, the heat sink 200 is coupled to the support bracket 168. In the illustrated embodiment, one post 244 is positioned in each quadrant and each post is formed integrally with the first elbow fin 260*a* (i.e., the elbow fin 260 positioned nearest the longitudinal fin 252 and the transverse fin 256). Each post 244 is positioned proximate the connecting portion 272*a* (FIG. 9) of the first elbow fin 260*a* and includes an opening 276 for receiving a fastener (e.g., a threaded fastener 280) extending through the support bracket 168 in order to couple the heat sink 200 to the lower surface 120 of the cross-member 112. In some embodiments, the posts 244 may extend above some or all of the fins 252, 256, 260.

The support bracket 168 has tabs 172 on each end, and each tab 172 includes a hole for receiving a fastener (FIG. 7) to couple the bracket 168 to the housing 100. The support bracket 168 is positioned between the extended third elbow fins 260 of the heat sink 200 and abuts the upper edges of the fins positioned between the extended third elbow fins 260. The ends of the support bracket 168 are coupled to the housing 100 (e.g., by fasteners), thereby supporting the heat sink 200 relative to the housing 100. The seal 174 between the support bracket 168 and the housing 100 thermally insulates the heat sink 200 from the housing 100 to reduce heat conduction to the housing 100. In addition, individual seals 284 (FIG. 6) may be placed adjacent the posts 244 and between the fin array 236 and the support bracket 168 to resist heat conduction from the heat sink 200 to the support bracket 168.

As best shown in FIG. 10, the mounting surface 232 of the plate 224 includes a first recess 288 and a second recess 292. The first recess 288 may be formed as a rectangular depression, and the second recess 292 may extend around the perimeter of the first recess 288.

Referring again to FIG. 7, the light assembly 300 is secured to the mounting surface 232 of the heat sink 200. The light assembly 300 includes a circuit board 304 supporting light-emitting elements such as light-emitting diodes (LEDs) 308 and a lens 312 positioned over the circuit board 304 and the light-emitting elements 308. The circuit board 304 is secured within the first recess 288 of the mounting surface 232 of the heat sink 200 and the lens 312 includes a peripheral portion coupled in the second recess 292. The lens 312 is directly to the mounting surface 232 independently of the circuit board 304. As a result, the lens 312 does not exert a compressive stress on the circuit board 304 and additional heat can be removed from the circuit board 304. In the illustrated embodiment, the circuit board 304 is coupled to the mounting surface 232 by a first set of fasteners 316 and the lens 312 is coupled to the mounting surface 232 by a second set of fasteners 320. A seal 322 is positioned between the circuit board 304 and the lens 312. A cover 324 is also coupled to the heat sink 200 and extends over the lens 312.

Air flow across the heat sink 200 could be restricted due to the fact that the heat sink 200 is positioned directly below the legs 108 and the support bracket 168 is positioned adjacent the upper edges of the fins 252, 256, 260. However, the grooves 194 on the inner side walls 156 of the housing 100 are aligned with the air flow channels between the elbow fins 260. As a result, the grooves 194 facilitate air flow from below the heat sink 200 and direct the flow toward the channels between the elbow fins 260 along the edges of the heat sink 200. The air flowing through the fin array 236 cools the fins 252, 256, 260, and the air is heated. The air flow is exhausted from the air flow channels adjacent the first end 204 or the second end 208 of the heat sink 200.

The heated air flow rises from the fin array 236 in the area proximate the side walls 140 of the cross-member 112. The air flow therefore exits the fin array 236 above the heat sink 200 but below the upper surface 116 of the cross-member 112. Because the exhaust point for the air flow is not at an uppermost point of the housing 100, the heated air continues to rise and can be cooled by ambient air. This avoids the possibility that the heated air will become trapped against a ceiling surface in the vicinity of the heat sink 200. By creating better air flow and allowing the exhausted air to continue to rise away from the heat sink 200, the operating temperature of the heat sink 200 is decreased and the efficiency is improved. As a result, the luminaire 10 has a longer working life.

In addition, the independent mounting of the heat sink 200 to the support bracket 168, as well as the seals between the heat sink 200, the support bracket 168, and the housing 100 significantly reduce conductive heat transfer from the heat sink 200 to the housing 100 or the housing's electrical components.

Although certain embodiments have been described in detail, variations and modifications exist within the scope and spirit of one or more independent aspects as described.

The invention claimed is:

1. A luminaire comprising:

a housing including a pair of elongated, parallel legs and a cross-member extending between the legs, the cross-member defining a first surface and a second surface spaced apart from the first surface, the first surface including an opening, each leg including an inner surface and a lower extent and at least one groove extending between the inner surface and the lower extent;

a heat sink coupled to the housing and positioned proximate the second surface of the cross-member, the heat sink positioned between the inner surface of the legs, the heat sink including a plate and a fin array, the plate defining a first surface and a second surface opposite the first surface, the fin array including a plurality of fins protruding from the first surface, and the fin array defining at least one air flow channel having an inlet and an outlet; and a light assembly coupled to the second surface of the heat sink, the light assembly including at least one light-emitting element, wherein the groove directs air flow from below the housing toward the at least one air flow channel, and wherein each leg includes an outer surface facing away from the other leg, at least one of the outer surfaces includes an opening to permit access to an internal compartment of the housing.

2. The luminaire of claim 1, wherein the light assembly includes a circuit board and a lens, the circuit board coupled to the second surface of the heat sink, the light-emitting element including a light-emitting diode, the lens coupled to the second surface of the heat sink independent of the circuit board.

3. The luminaire of claim 1, wherein the housing includes an axis extending between the first surface and the second surface, the axis positioned in a substantially vertical orientation, the cross-member extending in a direction perpendicular to the first axis.

4. The luminaire of claim 1, wherein the housing further includes a cover removably coupled to the one of the outer surfaces to selectively close the opening.

5. The luminaire of claim 1, wherein the heat sink includes at least one post extending away from the first surface, the housing further including at least one fastener extending from the housing to engage the post and removably couple the heat sink to the housing.

6. The luminaire of claim 1, further comprising a controller and a conduit in electrical communication with the controller, wherein the heat sink includes a hole extending through the plate, the conduit extending through the hole of the heat sink to provide electrical communication between the controller and the circuit board.

7. The luminaire of claim 1, wherein the cross-member includes a main body and a support bracket removably coupled to the main body, the first surface formed on the main body and the second surface formed on the support bracket, wherein the heat sink is removably coupled to the support bracket.

8. The luminaire of claim 7, wherein the housing further includes a seal positioned between the main body and the support bracket to thermally insulate the main body from the support bracket.

9. The luminaire of claim 7, wherein the support bracket includes a hole, wherein a conduit passes through the bracket hole such that the conduit is thermally insulated relative to the support bracket.

10. A luminaire comprising:

a housing including a pair of elongated, parallel legs and a cross-member extending between the legs, the cross-member defining a first surface and a second surface spaced apart from the first surface, the first surface including an opening, each leg including an inner surface and a lower extent and at least one groove extending between the inner surface and the lower extent;

a heat sink coupled to the housing and positioned proximate the second surface of the cross-member, the heat sink positioned between the inner surface of the legs, the heat sink including a plate and a fin array, the plate defining a first surface and a second surface opposite the first surface, the fin array including a plurality of fins protruding from the first surface, and the fin array defining at least one air flow channel having an inlet and an outlet; and a light assembly coupled to the second surface of the heat sink, the light assembly including at least one light-emitting element, wherein the groove directs air flow from below the housing toward the at least one air flow channel, and wherein the fin array defines at least one air flow channel extending from a first edge of the heat sink to a first end of the heat sink, wherein air flow is directed from the first edge of the heat sink and toward the first end of the heat sink.

11. The luminaire of claim 10, wherein each groove includes an angled surface extending between the lower extent and the inner surface for directing the air flow from below the housing into the at least one air flow channel.

12. The luminaire of claim 10, wherein the air flow exits the air flow channel at a location below the first surface of the cross-member.

13. The luminaire of claim 10, wherein the light assembly includes a circuit board and a lens, the circuit board coupled to the second surface of the heat sink, the light-emitting element including a light-emitting diode, the lens coupled to the second surface of the heat sink independent of the circuit board.

14. The luminaire of claim 10, wherein the housing includes an axis extending between the first surface and the second surface of the cross-member, the axis positioned in a substantially vertical orientation, the cross-member extending in a direction perpendicular to the first axis.

15. The luminaire of claim 10, wherein each leg includes an outer surface facing away from the other leg, and wherein at least one of the outer surfaces includes an opening to permit access to an internal compartment of the housing.

16. The luminaire of claim 15, wherein the housing further includes a cover removably coupled to the one of the outer surfaces to selectively close the opening.

17. The luminaire of claim 10, wherein the heat sink includes at least one post extending away from the first surface of the heat sink, the housing further including at least one fastener extending from the housing to engage the post and removably couple the heat sink to the housing.

18. The luminaire of claim 10, further comprising a controller and a conduit in electrical communication with the controller, wherein the heat sink includes a hole extending through the plate, the conduit extending through the hole of the heat sink to provide electrical communication between the controller and the circuit board.

19. The luminaire of claim 10, wherein the cross-member includes a main body and a support bracket removably coupled to the main body, the first surface of the cross-member formed on the main body and the second surface formed on the support bracket, wherein the heat sink is removably coupled to the support bracket.

20. The luminaire of claim 19, wherein the housing further includes a seal positioned between the main body and the support bracket to thermally insulate the main body from the support bracket.

21. The luminaire of claim 19, wherein the support bracket includes a hole, wherein a conduit passes through the bracket hole such that the conduit is thermally insulated relative to the support bracket.

22. A luminaire comprising:

a housing including a first portion and a second portion, the first portion having a first surface and a second surface spaced apart from the first surface, the first portion defining a first axis extending between the first surface and the second surface, the first surface including an opening configured to receive an electrical conduit in electrical communication with a power source, the first surface defining an uppermost portion of the housing;

a heat sink supported by the housing and positioned proximate the second surface, the heat sink including a plate and a fin array protruding from a surface of the plate, the plate having a first end, a second end, a first edge extending between the first end and the second end, and a second edge extending between the first end and the second end, the fin array defining at least one air flow channel having an inlet positioned proximate the first edge of the plate and an outlet positioned proximate one of the first end and the second end of the plate;

a light assembly including at least one light-emitting element and a lens, the light assembly coupled to a surface of the plate opposite the fin array, wherein the first portion of the housing includes a first side wall and a second side wall, the first side wall and the second side wall extending between the first surface and the second surface, wherein the heat sink defines a heat sink axis extending between the first end of the plate and the second end of the plate, and wherein the first end of the heat sink extends beyond the first side wall of the housing and the second end of the heat sink plate extends beyond the second side wall of the housing.

23. The luminaire of claim 22, wherein the housing further includes an elongated second portion connected to the first portion, the elongated portion oriented parallel to the heat sink axis and offset from the first axis, the second portion including a first end and a second end, the first end extending beyond the first side wall of the first portion, the second end extending beyond the second side wall of the first portion, the second portion further including a lower extent positioned below the second surface of the first portion.

24. The luminaire of claim 23, wherein the second portion includes an inner surface facing toward the heat sink, the second portion including at least one groove extending between the inner surface and the lower extent, the groove directing air flow from below the housing toward the at least one air flow channel.

25. The luminaire of claim 24, wherein the air flow is directed from the first side of the heat sink, past the at least one fin, and toward one of the first end and the second end of the heat sink, the air flow exiting the air flow channel at a location below the first surface of the first portion.

26. The luminaire of claim 22, wherein the fin array includes at least one fin having a first portion adjacent the first end of the plate and a second portion adjacent the first side of the plate, the second portion of the fin forming an angle relative to the first portion.

27. The luminaire of claim 22, wherein the first portion of the housing defines a main body and the second surface includes a support bracket removably coupled to the main body, wherein the heat sink is removably coupled to the support bracket.

28. The luminaire of claim 27, wherein the housing further includes a seal positioned between the main body and the support bracket to thermally insulate the main body from the support bracket.

29. The luminaire of claim 22, wherein the heat sink includes a hole extending through the plate, the luminaire further comprising a conduit passing through the hole and providing electrical communication with the circuit board.

* * * * *